US008618429B2

(12) United States Patent
Sugawara

(10) Patent No.: US 8,618,429 B2
(45) Date of Patent: Dec. 31, 2013

(54) KEYPAD ASSEMBLY, AND IMAGE FORMING DEVICE AND DATA PROCESSOR INCORPORATING THE SAME

(75) Inventor: Shun Sugawara, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 219 days.

(21) Appl. No.: 13/301,849

(22) Filed: Nov. 22, 2011

(65) Prior Publication Data

US 2012/0132509 A1 May 31, 2012

(30) Foreign Application Priority Data

Nov. 26, 2010 (JP) ..... 2010-263418

(51) Int. Cl.
*H01H 3/26* (2006.01)

(52) U.S. Cl.
USPC ..... 200/5 A; 200/343; 200/344; 200/345

(58) Field of Classification Search
USPC ..... 200/5 A, 5 E, 344, 341, 338, 335, 343
See application file for complete search history.

(56) References Cited

U.S. PATENT DOCUMENTS

| | | | | |
|---|---|---|---|---|
| 5,569,889 | A * | 10/1996 | Bruner | 200/5 A |
| 6,552,282 | B2 * | 4/2003 | Lewis | 200/5 A |
| 6,835,902 | B2 * | 12/2004 | Hiraoka | 200/5 A |
| 6,940,030 | B2 * | 9/2005 | Takeda et al. | 200/343 |
| 7,787,795 | B2 | 8/2010 | Sugawara et al. | |
| 2011/0100791 | A1 * | 5/2011 | Zhu et al. | 200/5 A |

FOREIGN PATENT DOCUMENTS

| | | |
|---|---|---|
| JP | 11-167457 | 6/1999 |
| JP | 4089118 | 3/2008 |

* cited by examiner

*Primary Examiner* — Renee S Luebke
*Assistant Examiner* — Ahmed Saeed
(74) *Attorney, Agent, or Firm* — Cooper & Dunham LLP

(57) ABSTRACT

A keypad assembly includes a first keypad element including a first frame element, first elastic elements connecting with the first frame element, keycaps swingably connected to the first frame element via the first elastic elements, and pressing elements protruding downward from the keycaps, and a second keypad element including a second frame element, second elastic elements connecting with the second frame element, keycaps swingably connected to the second frame element via the second elastic elements, and pressing elements protruding downward from the keycaps.

10 Claims, 5 Drawing Sheets

KEYPAD ASSEMBLY, AND IMAGE FORMING DEVICE AND DATA PROCESSOR INCORPORATING THE SAME

CROSS REFERENCE TO RELATED APPLICATION

The present application is based on and claims priority from Japanese Patent Application No. 2010-263418, filed on Nov. 26, 2010, the disclosure of which is hereby incorporated by reference in its entirety.

BACKGROUND OF THE INVENTION

1. Field of the Invention

The present invention relates to a keypad assembly having keycaps, and an image forming device and a data processor incorporating the same.

2. Description of the Prior Art

An image forming device such as a copier includes an operation panel through which a user gives an instruction to the device. The operation panel includes a key operation unit to which numeric values such as the number of copies or prints, facsimile numbers and else are input. Japanese Patent Application Publication No. 11-167457 (Reference 1) discloses a key operation unit with a keypad assembly of keycaps having keyswitches and extensions and keycaps not having keyswitches so that upon press to a certain keycap, the extensions of neighboring keycaps overlapping with the certain keycap are also pressed down to press the keyswitches, for example.

Japanese Patent No. 4089118 (Reference 2) discloses a keypad assembly which includes a first keypad element in which keycaps are arranged via an elastic arm element in a frame on which support portions vertically stand, and a second keypad element in which a single keycap is disposed at the center of a frame on which support portions vertically stand via an elastic arm element. The first keypad element is placed on the second keypad element and assembled into a device body.

Such a keypad assembly having partially overlapped keycaps or keypad elements can reduce its size and manufacturing costs. However, it has a drawback that it is applicable to composite keys such as cursor keys consisting of a center key and four surrounding keys or arrow keys tightly arranged without a gap but not applicable to a keypad structure such as a numerical keypad of keycaps in the same size and shape arranged vertically and horizontally with a constant interval. In particular, the keypad assembly in Reference 2 includes differently shaped elastic arms for the center keycap and the surrounding keycaps so that there are differences in key touches and key durability due to a difference in elastic force. Therefore, it is not suitable for a numerical keypad having the same size and function.

SUMMARY OF THE INVENTION

The present invention aims to provide a keypad assembly in which keycaps can be arranged with a constant interval in a small space, and an image forming device and a data processor incorporating such a keypad assembly.

According to one aspect of the present invention, a keypad assembly to be installed in a device body includes a first keypad element including a first frame element, first elastic elements connecting with the first frame element, keycaps swingably connected to the first frame element via the elastic elements, and pressing elements protruding downward from the keycaps, and a second keypad element including a second frame element, second elastic elements connecting with the second frame element, keycaps swingably connected to the second frame element via the second elastic elements, and pressing elements protruding downward from the keycaps, in which for mounting the keypad assembly on the device body, the first and second keypad elements are placed one on the other, so that the keycaps of the first keypad element and the key caps of the second keypad element are arranged with a constant interval on a same plane without vertically overlapping each other, top faces of all the keycaps are positioned at a same height, and the first and second frame elements are placed at a same position vertically and the first and second elastic elements are placed at a same position vertically.

BRIEF DESCRIPTION OF THE DRAWINGS

Features, embodiments, and advantages of the present invention will become apparent from the following detailed description with reference to the accompanying drawings.

DETAILED DESCRIPTION OF THE PREFERRED EMBODIMENT

Figure 1:
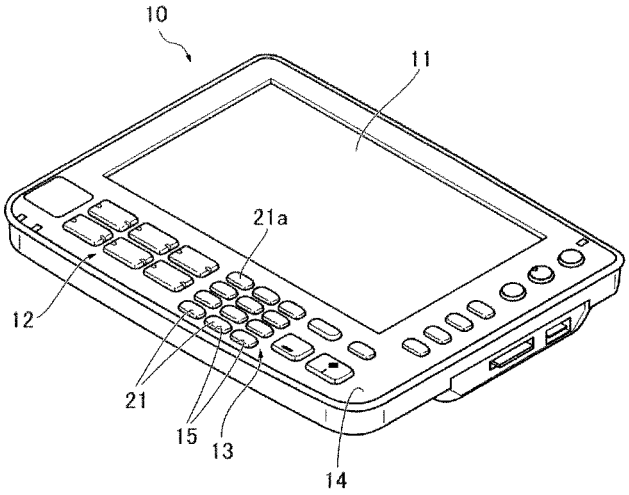
FIG. 1 is a perspective view of an operation panel including a key operation unit to which a keypad assembly according to one embodiment of the present invention is applied.
Figure 2:
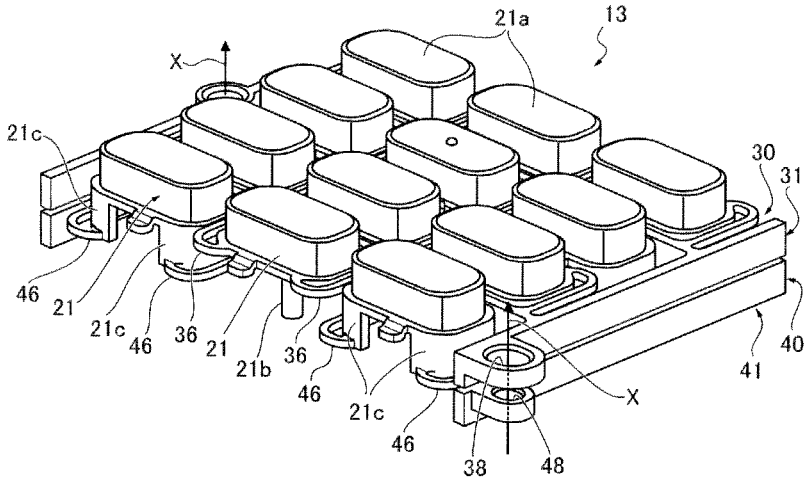
FIG. 2 is a perspective view of the key operation unit in FIG. 1 to which the keypad assembly is applied.
Figure 3B:
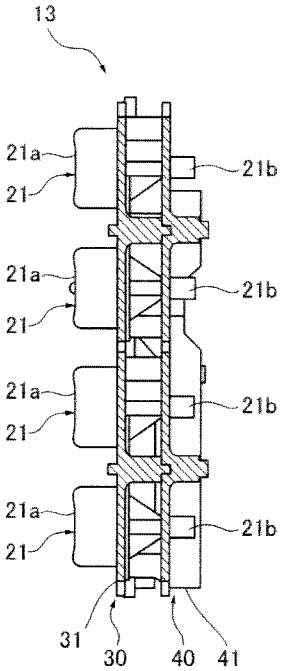
FIG. 3B is a cross section view of the same along an A to A line in FIG. 3A.
Figure 3A:
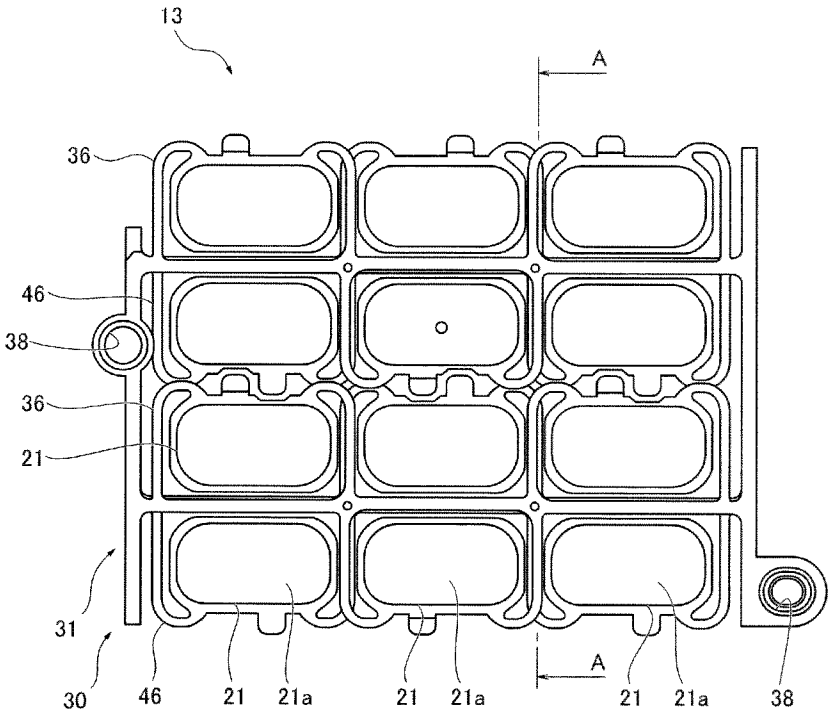
FIG. 3A is a plan view of the key operation unit in FIG. 1
Figure 4B:
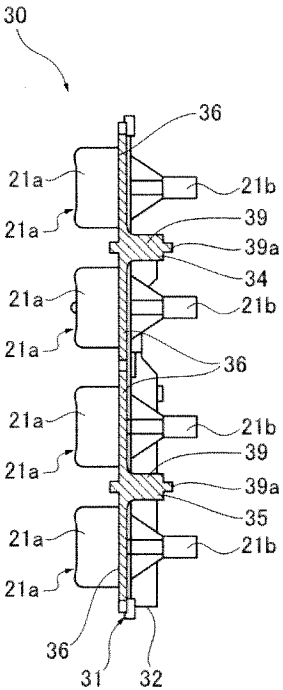
FIG. 4A is a plan view of a first keypad element of the key operation unit and FIG. 4B is a cross section view of the same along a B to B line in FIG. 4A.
Figure 4A:
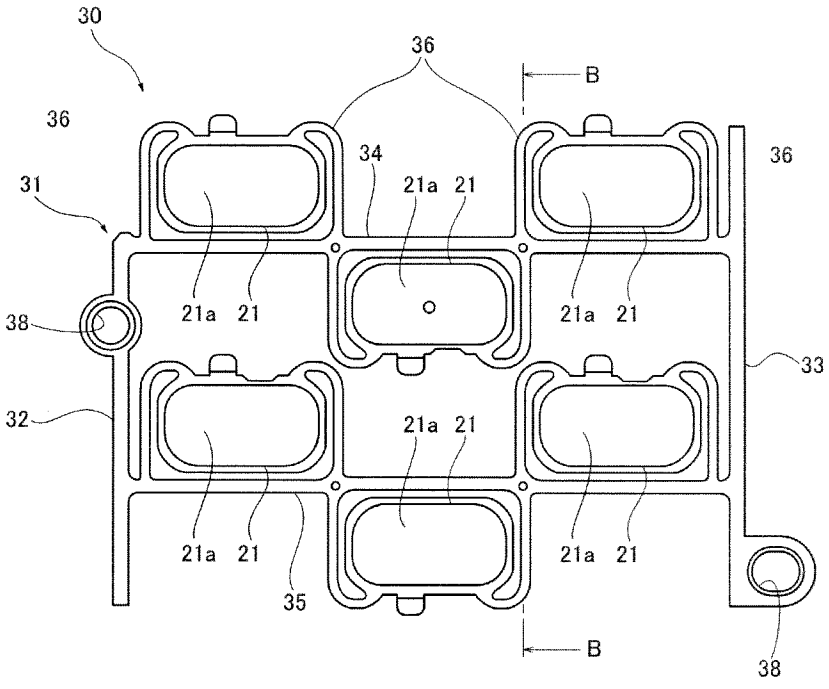
Figure 5B:
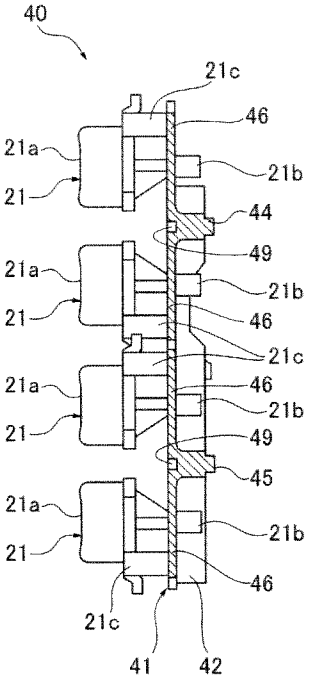
FIG. 5A is a plan view of a second keypad element of the key operation unit and FIG. 5B is a cross section view of the same along a C to C line in FIG. 5A.
Figure 5A:
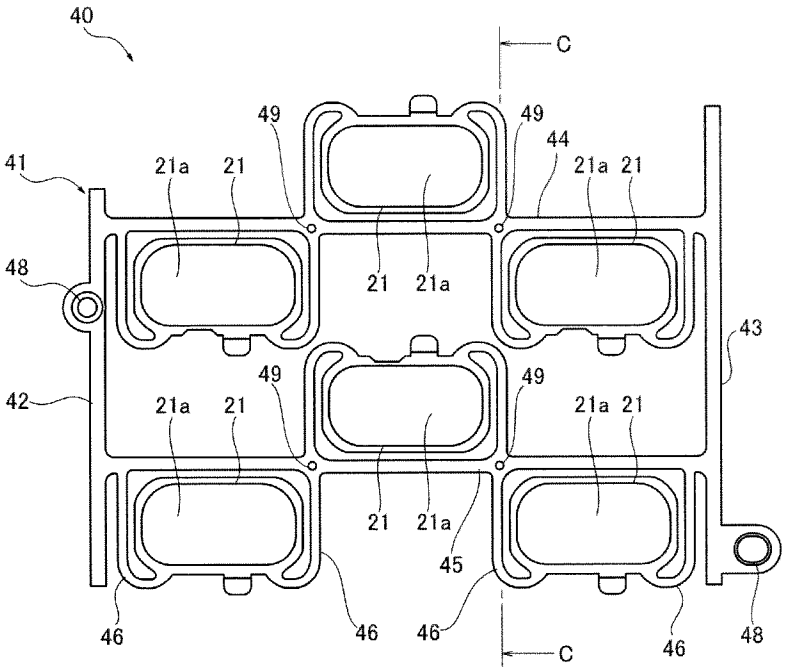

Hereinafter, one embodiment of the present invention will be described in detail with reference to the accompanying drawings. FIG. 1 is a perspective view of an operation panel including a key operation unit to which a keypad assembly according to the present embodiment is applied. FIG. 2 is a perspective view of the key operation unit in FIG. 1 to which the keypad assembly is applied. FIG. 3A is a plan view of the key operation unit in FIG. 1 and FIG. 3B is a cross section view of the same along an A to A line in FIG. 3A. FIG. 4A is a plan view of a first keypad element of the key operation unit and FIG. 4B is a cross section view of the same along a B to B line in FIG. 4A. FIG. 5A is a plan view of a second keypad element of the key operation unit and FIG. 5B is a cross section view of the same along a C to C line in FIG. 5A.

FIG. 1 shows an example of an image forming device such a copier, printer, facsimile machine or combined machine incorporating an operation panel 10. The operation panel 10 includes a display 11 such as LCD, an operation unit 12 having various functions and a panel body 14. Various settings such as numerical values inputted via the operation unit 12 are displayed on the display 11.

The operation unit 12 includes a numerical keypad 13 with which numeric values such as the number of prints, facsimile number or else are input. The numerical keypad 13 includes twelve keycaps 21 including ones to indicate numeric characters 0 to 9. The keycaps 21 with rectangular top faces 21*a* are protruded from keyholes 15 in the panel body 14 and not-shown keyswitches are provided below the keycaps 21, respectively. Upon a user's press onto a certain top face 21*a*, a corresponding keyswitch is operated.

As shown in FIG. 2 and FIGS. 3A, 3B, the numerical keypad 13 is comprised of a first keypad element 30 and a second keypad element 40 molded from synthetic resin as plastic. The first keypad element 30 is placed on the second keypad element 40 and installed in the body of the image forming device. Thus, the twelve keycaps 21 of the same shape are arranged with a constant interval longitudinally and transversely on the same plane. The top faces 21*a* are at the same height.

The keycaps 21 each include, on the bottom face, a pressing element 21*b* protruding downward so that the end thereof comes near the top of the keyswitch. Upon a user's press to the top face 21*a* of the keycap 21, the pressing element 21*b* is pressed down to turn on the corresponding keyswitch.

As shown in FIGS. 4A, 4B, the first keypad element 30 includes a first frame element 31 which is to be fixed in the device body and comprised of two outer frame portions 32, 33 in parallel with each other and two inner frame portions 34, 35 connecting the outer frame portions 32, 33 orthogonally, seen from the top face 21*a* side. Six keycaps 21 are alternately arranged on both sides of the inner frame portions 34, 35 and each of them is held by a pair of elastic arms 36 as first elastic element extending from the inner frame portions 34, 35 along both sides of each keycap or in the orthogonal direction.

The pair of elastic arms 36 extends along both sides of each keycap beyond the center of the top face 21*a* and is then bent to connect each keycap 21. The respective keycaps 21 are swingably connected with the inner frame element 31 via the elastic arms 36.

The two outer frame portions 32, 33 each include an opening 38 as positioning element while the two inner frame portions 34, 35 each include a support portion 39 having a pin 39*a* at an end as positioning element protruding downward.

As shown in FIGS. 5A, 5B, the second keypad element 40 includes a second frame element 41 which is to be fixed in the device body and comprised of two outer frame portions 42, 43 in parallel with each other and two inner frame portions 44, 45 connecting the outer frame portions 42, 43 orthogonally, seen from the top face 21*a* side. Six keycaps 21 are alternately arranged on both sides of the inner frame portions 44, 45 and held by a pair of elastic arms 46 as second elastic element extending from the inner frame portions 44, 45 along both sides of each keycap or in the orthogonal direction.

The pair of elastic arms 46 extends along both sides of each keycap beyond the center of the top face 21*a* and is then bent to connect each keycap 21. The respective keycaps 21 are swingably connected with the second frame element 41 via the elastic arms 46.

In the second keypad element 40 each keycap 21 includes an extension 21*c* extending downward and connected at the bottom end with one end of the elastic arm 46. Thereby, the keycaps 21 of the second keypad element 40 held by the elastic arms 46 are arranged above the second frame element 41 including the elastic arms 46.

The outer frame portions 42, 43 constituting the second frame element 41 each include an opening 48 as positioning element while the inner frame portions 44, 45 each include an opening 49 as positioning element to engage with the pin 39*a* of the first frame element 31.

The first keypad element 30 is laid on the second keypad element 40 to constitute the numerical keypad 13. The keycaps 21 of the first keypad element 30 and those of the second keypad element 40 are alternately arranged. Moreover, having the extensions 21*c* connecting with the elastic arms 46, the keycaps 21 of the second keypad element 40 are placed above the second frame element 41 including the elastic arms 46, so that they can be fitted into the intervals between the keycaps 21 of the first keypad element 30, respectively. Because of this, in the numerical keypad 13 the twelve keycaps 21 of the same shape can be arranged with a constant interval longitudinally and transversely on the same plane without vertically overlapping with each other, and the top faces 21*a* can be at the same height.

Thus, when the first keypad element 30 is placed on the second keypad element 40, the first and second frame elements 31, 41 come to the same position vertically and so do the elastic arms 36 of the first keypad element 30 and the elastic arms 46 of the second keypad element 40. This makes it possible to reduce the external dimensions of the numerical keypad 13 and place the numerical keypad 13 in a smaller space. Further, the elastic arms 36 of the first keypad element 30 and the elastic arms 46 of the second keypad element 40 are arranged at different heights with a gap vertically.

Moreover, with the first frame element 31 placed on the second frame element 41, the openings 38 of the outer frame portions 32, 33 of the first keypad element 30 are brought in communication with the openings 48 of the outer frame portions 42, 43 of the second keypad element 40. In mounting the first and second keypad elements 30, 40 on the device body in this state, not-shown positioning pins of the device body are inserted through the communicated openings 38 and 48 from below as indicated by the arrow X in FIG. 2. Thus, the first keypad element 30 and the second keypad element 40 can be assembled at precise positions in planar direction.

Further, by placing the first frame element 31 on the second frame element 41, the pins 39*a* of the support portions 39 of the first frame element 31 are fitted into the openings 49 of the second frame element 41. Because of this, the first keypad element 30 and the second keypad element 40 can be assembled at precise positions in planar direction.

The thus-assembled numerical keypad 13 is attached to the device body in a predetermined position in which the keyswitches are provided. Then, the panel body 14 is set to the numerical keypad 13 so that the twelve keycaps 21 are protruded through the keyholes 15 of the panel body 14. This completes the assembly of the operation panel 10. In the operation panel 10 numeric values such as the number of prints or facsimile numbers can be input to the device via the numerical keypad 13.

Upon the user's press onto the top faces 21*a* of the keycaps 21 on the numerical keypad 13 for numeric inputs, the corresponding elastic arms 36 and 46 are deformed to press down the pressing elements 21*b* of the keycaps 21 to turn on the keyswitches. When the user releases his/her finger from the top faces 21*a*, the elastic arms 36 and 46 are restored to return the keycaps 21 to the original position and release the pressing elements 21*b* to turn off the keyswitches.

The elastic arms 36 holding the keycaps 21 of the first keypad element 30 and 46 holding the keycaps 21 of the second keypad element 40 are placed vertically at the same position but at different heights. Therefore, upon the user's press to the keycaps 21 of the first keypad element 30 in the upper position, the deformation of the elastic arms 36 does not interfere with the elastic arms 46 supporting the keycaps 21 of the second keypad element 40. Because of this, in the numerical keypad 13 all the keycaps 21 can be smoothly operated.

As described above, according to the present embodiment the first and second keypad elements 30, 40 are placed one upon the other so that the same shaped keycaps 21 held by the elastic arms 36, 46 can be arranged in the same plane without vertically overlapping each other with the top faces 21*a* at the same height. Further, the first and second frame elements 31, 41 and the elastic arms 36, 46 are placed at the same position vertically. This makes it possible to closely arrange the keycaps 21 with a constant interval in a small space.

Moreover, the numeric keypad 13 is configured that each keycap 21 is supported by the pair of elastic arms 36 or 46 extending along both side of the keycap. Therefore, it is possible to eliminate the differences in key touch and key durability due to a difference in elastic force. Thus, a keypad assembly suitable for a numerical keypad of keys having the same shape and function, for example, can be provided.

Moreover, the pairs of elastic arms 36, 46 configured above can smoothly, swingably support the corresponding keycaps so that good, smooth key operation can be realized.

Note that the above embodiment has described an example where the keycaps 21 are alternately arranged on both sides of the inner frame portions 34, 35, 44, 45. However, they can be alternately arranged on either side of the inner frame portions 34, 35, 44, 45.

The present embodiment has described an example of the keypad assembly applied to an image forming device such a copier, printer, facsimile machine or combined machine. However, the present invention should not be limited to such an example. It can be applied to a data processor such as a personal computer with a keyboard including a numeric keypad.

Although the present invention has been described in terms of exemplary embodiments, it is not limited thereto. It should be appreciated that variations or modifications may be made in the embodiments described by persons skilled in the art without departing from the scope of the present invention as defined by the following claims.

What is claimed is:

1. A keypad assembly to be installed in a device body, comprising:

a first keypad element including a first frame element, first elastic elements connecting with the first frame element, keycaps swingably connected to the first frame element via the elastic elements, and pressing elements protruding downward from the keycaps; and a second keypad element including a second frame element, second elastic elements connecting with the second frame element, keycaps swingably connected to the second frame element via the second elastic elements, and pressing elements protruding downward from the keycaps, wherein for installing the keypad assembly in the device body, the first and second keypad elements are placed one on the other, so that the keycaps of the first keypad element and the key caps of the second keypad element are arranged with a constant interval on a same plane without vertically overlapping each other and top faces of all the keycaps are positioned at a same height, and the first and second frame elements are placed at a same position vertically and the first and second elastic elements are placed at a same position vertically.

2. The keypad assembly according to claim 1, wherein:

the first and second frame elements each include outer frame portions disposed in parallel to each other and an inner frame portion orthogonally connecting the outer frame portions;

the elastic elements are paired to hold each of the keycaps, and extend from the inner frame portion orthogonally along both sides of each keycap.

3. The keypad assembly according to claim 2, wherein the pair of elastic elements is configured to extend from the inner frame portion orthogonally along both sides of each keycap beyond a center of the top face of each keycap, and then be bent to connect to each keycap.

4. The keypad assembly according to claim 2, wherein the keycaps are alternately arranged on both sides of the inner frame portion.

5. The keypad assembly according to claim 2, wherein keycaps are alternately arranged on either side of the inner frame portion.

6. The keypad assembly according to claim 1, wherein first and second frame elements include positioning elements configured to be able to fit into each other.

7. An image forming device comprising the keypad assembly according to claim 1.

8. An image forming device according to claim 7, wherein the keycaps are illustrated to indicate at least numerals zero to 9.

9. A data processor comprising the keypad assembly according to claim 1.

10. A data processor according to claim 9, wherein the keycaps are illustrated to indicate at least numerals zero to 9.

* * * * *